US007118429B1

(12) United States Patent
Fabian

(10) Patent No.: US 7,118,429 B1
(45) Date of Patent: Oct. 10, 2006

(54) ELECTRICAL CONTACT WITH WIRE TRAP

(75) Inventor: David J Fabian, Mount Joy, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/343,570

(22) Filed: Jan. 31, 2006

(51) Int. Cl.
*H01R 11/22* (2006.01)

(52) U.S. Cl. ..... 439/852; 439/861; 439/739; 439/438; 439/749

(58) Field of Classification Search ..... 439/852, 439/861, 739, 749, 438, 439
See application file for complete search history.

(56) References Cited

U.S. PATENT DOCUMENTS 3,748,634 A * 7/1973 Barnes et al. ..... 439/852
4,729,740 A 3/1988 Crowe et al.
6,428,343 B1 8/2002 Landis et al.
6,827,613 B1 * 12/2004 Ferderer ..... 439/805

* cited by examiner

*Primary Examiner*—Truc Nguyen

(57) ABSTRACT

An electrical terminal including a body having a contact gripping element where the contact gripping element is resiliently biased or disposed in a channel. The contact gripping element is configured to exert a contact gripping force on an electrical conductor. Preferably, the body has a seam transverse to the contact gripping element. More preferably the seam can widen upon insertion of the electrical conductor. Most preferably the seam can reduce the radial force upon the contact gripping element as a way to relax stress on the contact gripping element.

22 Claims, 2 Drawing Sheets

ELECTRICAL CONTACT WITH WIRE TRAP

BACKGROUND OF THE INVENTION

The subject matter relates to an improved electrical terminal and more particularly to an improved wire trap for the electrical connection and retention of an electrical conductor within an electrical connector.

Electrical terminals are well known in the connector industry. Typically, the terminals include a pin and mating socket, together with a conductor connecting portion. In the event that the terminals are connected to wires, the terminals include a wire connecting section. One such form of wire connecting section is the wire crimp, where the wire is stripped and placed in a terminal end, and then crimped in placed where the metal deforms about the conductor to make the electrical connection.

It is desirable in certain applications to not require a crimped connection. Typically, this is in the situation where the wires are stripped on site, and where crimping tools are not readily available. An example of such a situation would be in the lighting industry where overhead lights are installed, and it is easier for the installer to not require a crimped connection.

The objects of the invention are therefore to improve upon these known connection systems.

SUMMARY OF THE INVENTION

The objects of the invention have been accomplished by providing an electrical terminal comprising an open ended body defining a channel where the channel is configured to receive an electrical conductor and a contact gripping element is resiliently biased into the channel where the contact gripping element is associated with the body and the contact gripping element is configured to exert a contact gripping force on the electrical conductor. In a couple of variations, the contact gripping element is a beam or a leaf spring. Further embodiments comprise where the contact gripping element is resiliently moveable in a radial direction and where the insertion of the electrical conductor exerts a radial force upon the contact gripping element.

In another variation, the body includes a longitudinal seam extending along a length of the body from the open end to a second end of the body. Furthermore, the contact gripping element is transverse to the seam. Preferably, the body is configured such that the seam widens upon insertion of the electrical conductor into the channel. More preferably, the seam is configured to reduce the radial force applied upon the contact gripping element.

Most preferably, the seam comprises a way for relaxing stress on the contact gripping element. When an electrical conductor is inserted into the channel, the electrical conductor places a radial force on the contact gripping element. During insertion of the electrical conductor, the electrical conductor can place a force on the inside surface of the body on the side opposite of the contact gripping element. Since the contact gripping element is resiliently biased in the channel, this radial force may put stress on the contact gripping element at the point of association to the body of the electrical terminal. When the seam is transverse to the contact gripping element, the seam can widen and reduce the radial force placed upon the contact gripping element by the electrical conductor.

In yet another embodiment, a terminal for retention of an electrical conductor comprises an electrical terminal including a contact gripping element, a channel and an aperture.

The contact gripping element is disposed through the aperture. The contact gripping element has a distal end disposed in the channel and is configured to be displaced by the electrical conductor where the contact gripping element is configured to exert a contact gripping force on the electrical conductor disposed in the channel. In a couple of variations, the contact gripping element is an arch and a leaf spring.

Further embodiments comprise where the contact gripping element is resiliently moveable in a radial direction and where the insertion of the electrical conductor exerts a radial force upon the contact gripping element.

In another variation, the body includes a longitudinal seam extending along a length of the body from the open end to a second end of the body. Furthermore, the contact gripping element is transverse to the seam. Preferably, the body is configured such that the seam widens upon insertion of the electrical conductor into the channel. More preferably, the seam is configured to reduce the radial force applied upon the contact gripping element.

Most preferably, the seam comprises a way for relaxing stress on the contact gripping element. When an electrical conductor is inserted into the channel, the electrical conductor places a radial force on the contact gripping element. During insertion of the electrical conductor, the electrical conductor can place a force on the inside surface of the body on the side opposite of the contact gripping element. Since the contact gripping element is disposed in the channel, this radial force may put stress on the contact gripping element at the point of association to the body of the electrical terminal. When the seam is transverse to the contact gripping element, the seam can widen and reduce the radial force placed upon the contact gripping element by the electrical conductor.

DETAILED DESCRIPTION OF THE PREFERRED EMBODIMENT

Figure 1:
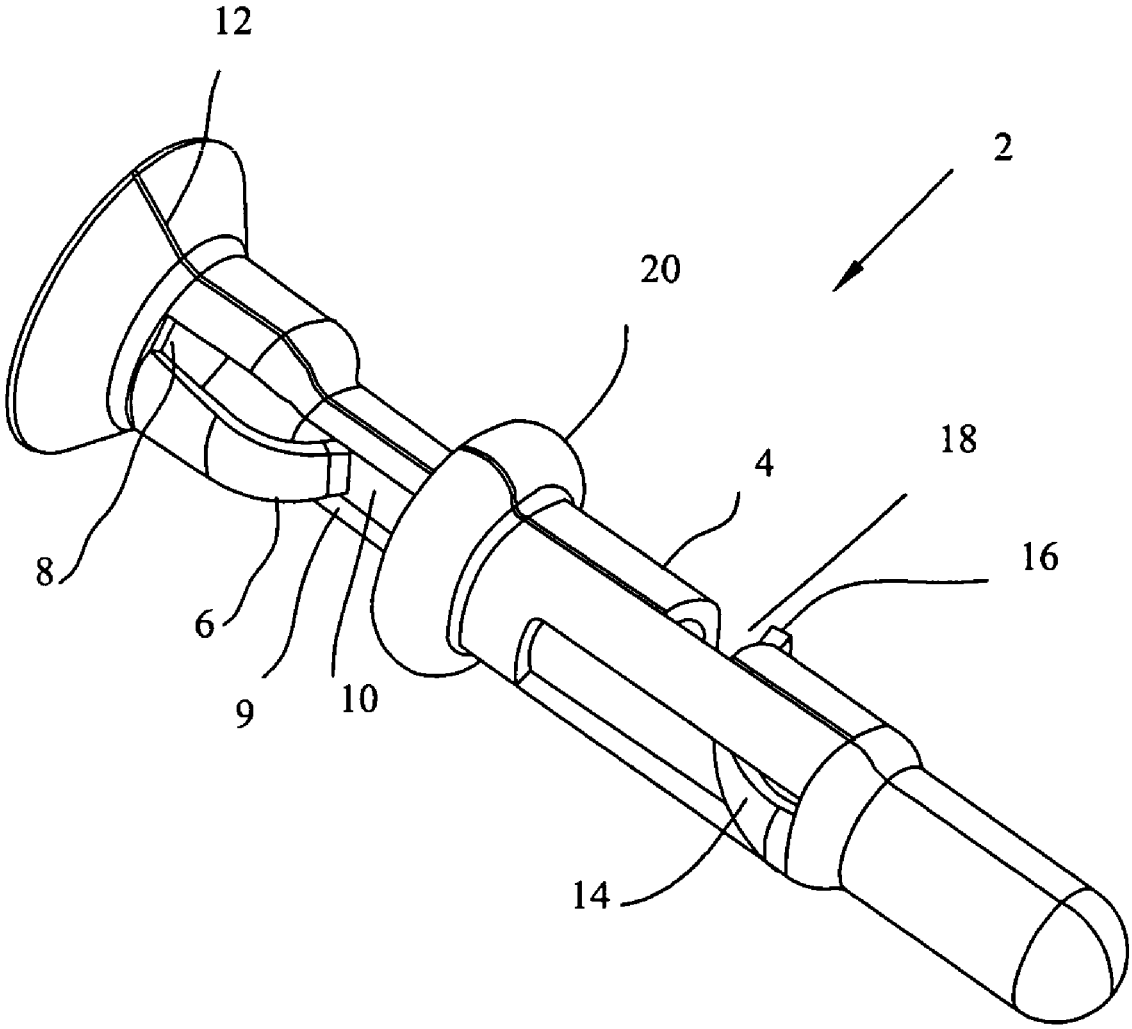
FIG. 1 is a perspective view showing the electrical terminal of the present invention.

With reference to FIG. 1, an embodiment of an electrical terminal is shown at 2, having a body 4, contact gripping element 6, open end 8, aperture 9 and channel 10. Body 4 also has seam 12. The stamped terminal is comprised of an adequately conductive material, such as a Copper alloy material.

It should be appreciated by those skilled in the art that the terminal 2 is stamped and formed from a blank material where the seam is formed from the side edges of the blank being roll formed against each other. Preferably, contact gripping element 6 is formed transverse to seam 12, that is, in a radial position.

Figure 2:
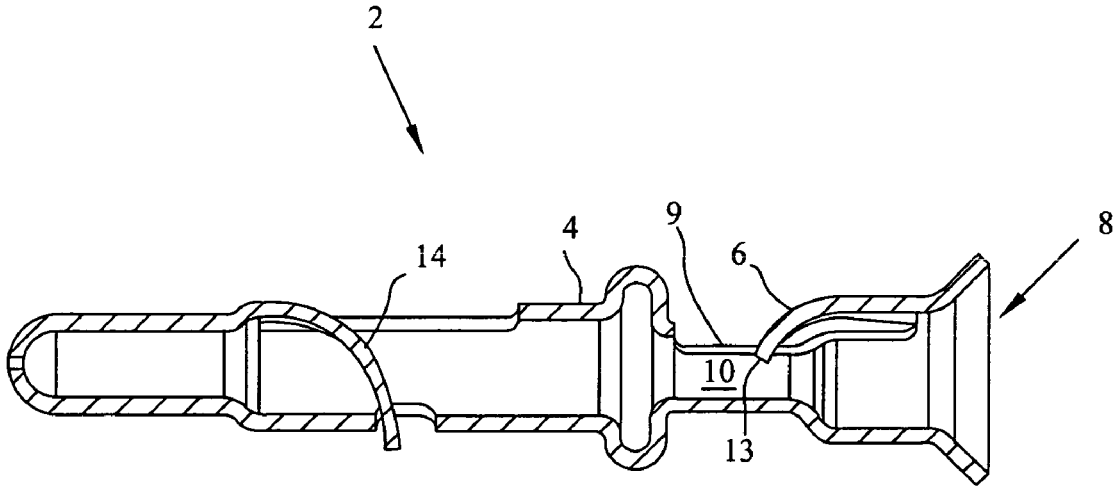
FIG. 2 is a longitudinal cross-sectional view showing the electrical terminal of the present invention.

As best shown in FIG. 2, contact gripping element 6 is shown resiliently biased into channel 10. Contact gripping element 6 may be cut out or stamped out from body 4, but as shown, is stamped from the blank of material from which it is formed. Contact gripping element 6 may be resiliently biased into the form of a leaf spring or beam structure, as shown best in FIG. 2. The distal end 13 of contact gripping element 6 also forms a contact section as will be further described below.

Referring again to FIG. 1, body 4 further includes locking member 14 having locking portion 16, aperture 18, and projection 20, which are further described in co-pending patent application Ser. No. 60/763,636, filed on even date herewith, and incorporated herein by reference. With the individual components previously described, the function of electrical terminal 2 will now be described in greater detail.

As mentioned above, contact gripping element 6 is resiliently biased into channel 10. An insulated wire 22 may be prepared such that the conductor 24 is exposed, and the electrical conductor 24 may be inserted through open end 8 and into channel 10, whereupon distal contact section 13 of contact gripping element 6 is resiliently moved in a radial direction to exert a contact gripping and contacting force on the electrical conductor 24.

Figure 3:
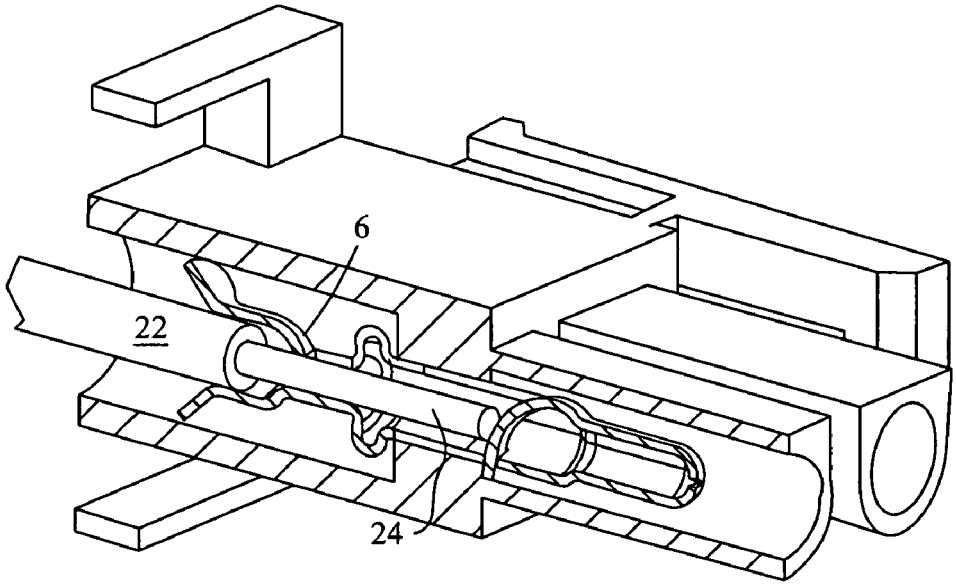
FIG. 3 is a cross-sectional view showing the electrical terminal associated with an electrical conductor and a connector housing.

As longitudinal seam 12 is positioned radially transverse to contact gripping element 6, body 4 can be configured to reduce stress applied on the contact gripping element 6 when an electrical conductor is inserted into channel 10, as the seam can slightly open and relieve the stress in the elongate beam section of contact gripping element 6. As shown in FIG. 3, contact gripping element 6 exerts a contact gripping contact force on electrical conductor 24.

What is claimed is:

1. An electrical terminal, comprising:

an open ended body defining a channel, said channel having a perimeter and being configured to receive an electrical conductor; and a contact gripping element including a first portion exterior to the channel and forming a gap between the first portion and the perimeter of the channel, the contact gripping element further including a second portion resiliently biased into said channel, said contact gripping element associated with said body, said contact gripping element configured to exert a contact gripping contact force on the electrical conductor.

2. The electrical terminal of claim 1, wherein said contact gripping element is a beam.

3. The electrical terminal of claim 1, wherein said contact gripping element is a leaf spring.

4. The electrical terminal of claim 1, wherein said contact gripping element is resiliently moveable in a radial direction.

5. The electrical terminal of claim 4, wherein the insertion of the electrical conductor exerts a radial force upon said contact gripping element.

6. An electrical terminal, comprising:

an open ended body including a longitudinal open seam extending along a length of said body from said open end to a second end of said body and defining a channel, said channel configured to receive an electrical conductor; and a contact gripping element resiliently biased into said channel, said contact gripping element associated with said body, said contact gripping element configured to exert a contact gripping contact force on the electrical conductor.

7. The electrical terminal of claim 6, wherein said contact gripping element is transverse to said seam.

8. The electrical terminal of claim 6, wherein said body is configured to deflect such that said seam widens upon insertion of the electrical conductor into said channel.

9. The electrical terminal of claim 6, wherein the seam defines a gap.

10. The electrical terminal of claim 8, wherein said deflection of the body resulting in the widening of the seam is configured to reduce said radial force applied upon said contact gripping element.

11. The electrical terminal of claim 8, wherein said body comprises a means for relaxing of stress on said contact gripping element.

12. A terminal for retention of an electrical conductor, comprising:

an electrical terminal including a contact gripping element, a channel and an aperture, said contact gripping element disposed through said aperture such that a proximal end of said contact gripping element is outside of the channel and on an opposite side of said aperture relative to a distal end of said contact gripping element that is disposed in said channel, said contact gripping element configured to be displaced by the electrical conductor, said contact gripping element configured to exert a contact gripping force on the electrical conductor disposed in said channel.

13. The terminal of claim 12, wherein said contact gripping element is an arch.

14. The terminal of claim 12, wherein said contact gripping element is a leaf spring.

15. The terminal of claim 12, wherein said contact gripping element is resiliently moveable in a radial direction.

16. The terminal of claim 15, wherein the insertion of the electrical conductor exerts a radial force upon said contact gripping element.

17. A terminal for retention of an electrical conductor, comprising:

an electrical terminal including a contact gripping element, a channel, an aperture, and a longitudinal open seam extending along said electrical terminal from a first longitudinal end to a second longitudinal end of said electrical terminal, said contact gripping element disposed through said aperture, said contact gripping element having a distal end disposed in said channel, said contact gripping element configured to be displaced by the electrical conductor, said contact gripping element configured to exert a contact gripping force on the electrical conductor disposed in said channel.

18. The terminal of claim 17, wherein said contact gripping element is transverse to said seam.

19. The terminal of claim 18, wherein said electrical terminal is configured to deflect such that said seam widens upon insertion of the electrical conductor into said channel.

20. The terminal of claim 19, wherein said deflection of the electrical terminal resulting in the widening of the seam is configured to reduce said radial force applied upon said contact gripping element.

21. The terminal of claim 19, wherein said electrical terminal comprises a means for relaxing of stress on said contact gripping element.

22. The terminal of claim 17, wherein the seam defines a gap.

* * * * *